US005797410A

United States Patent [19]

Gates

[11] Patent Number: 5,797,410

[45] Date of Patent: Aug. 25, 1998

[54] CLEAR VIEW WASH SHIELD

[76] Inventor: Steven C. Gates, P.O Box 1904, Elfers, Fla. 34680

[21] Appl. No.: 867,055

[22] Filed: Jun. 2, 1997

[51] Int. Cl.[6] ..... B08B 3/02

[52] U.S. Cl. ..... 134/138; 134/900; 206/15.3; 206/361; 220/4.21; 220/4.24

[58] Field of Search ..... 134/900, 138; 15/230.11, 236.03, 248.2; 206/15.3, 349, 361, 463; 220/4.21, 4.23, 4.24, 4.25; 401/208, 219

[56] References Cited

U.S. PATENT DOCUMENTS

| | | | |
|---|---|---|---|
| 4,735,221 | 4/1988 | Vegiard | 134/138 |
| 5,238,012 | 8/1993 | Coronato | 134/900 X |
| 5,539,950 | 7/1996 | Zar et al. | 15/248.2 |
| 5,626,158 | 5/1997 | Gratopp | 134/900 X |
| 5,651,381 | 7/1997 | Balouchian | 134/900 X |

*Primary Examiner*—Philip R. Coe
*Attorney, Agent, or Firm*—American Innovations Inc.

[57] ABSTRACT

A new clear view wash shield for washing a paint roller and permitting viewing of the washing operation. The inventive device includes first and second transparent shield halves, with each half having a generally flat portion and a semi-cylindrical raised portion within each flat portion. The raised portions form a cylindrical housing for a paint roller when the shield halves are connected together. One of the semi-cylindrical raised portions includes a flexible water inlet flap thereon through which water from a spray nozzle is introduced into the cylindrical housing. The shield halves include interfitting projections and grooves for connecting the shield halves together, and each shield half includes a semi-cylindrical handle portion. The handle portions form a handle housing for enclosing the handle of the paint roller when the shield halves are connected together. The transparent nature of the shield halves permit viewing of the paint roller while being washed, thus enabling the user to determine when the roller is clean.

9 Claims, 4 Drawing Sheets

CLEAR VIEW WASH SHIELD

BACKGROUND OF THE INVENTION

1. Field of the Invention

The present invention relates to paint roller wash shields and more particularly pertains to a new clear view wash shield for washing a paint roller and permitting viewing of the washing operation.

2. Description of the Prior Art

The use of paint roller wash shields is known in the prior art. Known prior art paint roller wash shields include U.S. Pat. No. 4,735,221; U.S. Pat. No. 4,765,353; U.S. Pat. No. 4,765,354; U.S. Pat. No. 4,711,258; U.S. Pat. No. 4,672,987; U.S. Pat. No. 4,641,673; U.S. Pat. No. 3,897,797; U.S. Pat. No. 3,886,960; U.S. Pat. No. 3,139,891; U.S. Pat. No. 2,713,868; U.S. Pat. No. 4,778,534; U.S. Pat. No. 4,606,777; U.S. Pat. No. 4,401,476; U.S. Pat. No. 4,263,055; U.S. Pat. No. 4,126,484; U.S. Pat. No. 3,436,264; and U.S. Pat. No. 4,380,478.

While these devices fulfill their respective, particular objectives and requirements, the aforementioned patents do not disclose a new clear view wash shield. The inventive device includes first and second transparent shield halves, with each half having a generally flat portion and a semi-cylindrical raised portion within each flat portion. The raised portions form a cylindrical housing for a paint roller when the shield halves are connected together. One of the semi-cylindrical raised portions includes a flexible water inlet flap thereon through which water from a spray nozzle is introduced into the cylindrical housing. The shield halves include interfitting projections and grooves for connecting the shield halves together, and each shield half includes a semi-cylindrical handle portion. The handle portions form a handle housing for enclosing the handle of the paint roller when the shield halves are connected together. The transparent nature of the shield halves permit viewing of the paint roller while being washed, thus enabling the user to determine when the roller is clean.

In these respects, the clear view wash shield according to the present invention substantially departs from the conventional concepts and designs of the prior art, and in so doing provides an apparatus primarily developed for the purpose of washing a paint roller and permitting viewing of the washing operation.

SUMMARY OF THE INVENTION

The general purpose of the present invention, which will be described subsequently in greater detail, is to provide a new clear view wash shield which has many of the advantages of the paint roller wash shields mentioned heretofore and many novel features that result in a new clear view wash shield which is not anticipated, rendered obvious, suggested, or even implied by any of the prior art paint roller wash shields, either alone or in any combination thereof.

To attain this, the present invention generally comprises first and second transparent shield halves, with each half having a generally flat portion and a semi-cylindrical raised portion within each flat portion. The raised portions form a cylindrical housing for a paint roller when the shield halves are connected together. One of the semi-cylindrical raised portions includes a flexible water inlet flap thereon through which water from a spray nozzle is introduced into the cylindrical housing. The shield halves include interfitting projections and grooves for connecting the shield halves together, and each shield half includes a semi-cylindrical handle portion. The handle portions form a handle housing for enclosing the handle of the paint roller when the shield halves are connected together. The transparent nature of the shield halves permit viewing of the paint roller while being washed, thus enabling the user to determine when the roller is clean.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is therefore an object of the present invention to provide a wash shield which enables washing of a paint roller. It is a further object of the present invention to provide a wash shield which is transparent so as to permit viewing of the washing operation to determine when the roller is clean. It is an even further object of the present invention to provide a wash shield which automatically centers the roller and handle for proper cleaning. It is also an object of the present invention to provide a wash shield which is universal such that it can clean all sizes of paint rollers. It is a further object of the present invention to provide a wash shield which can be used in a vertical position or a horizontal position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
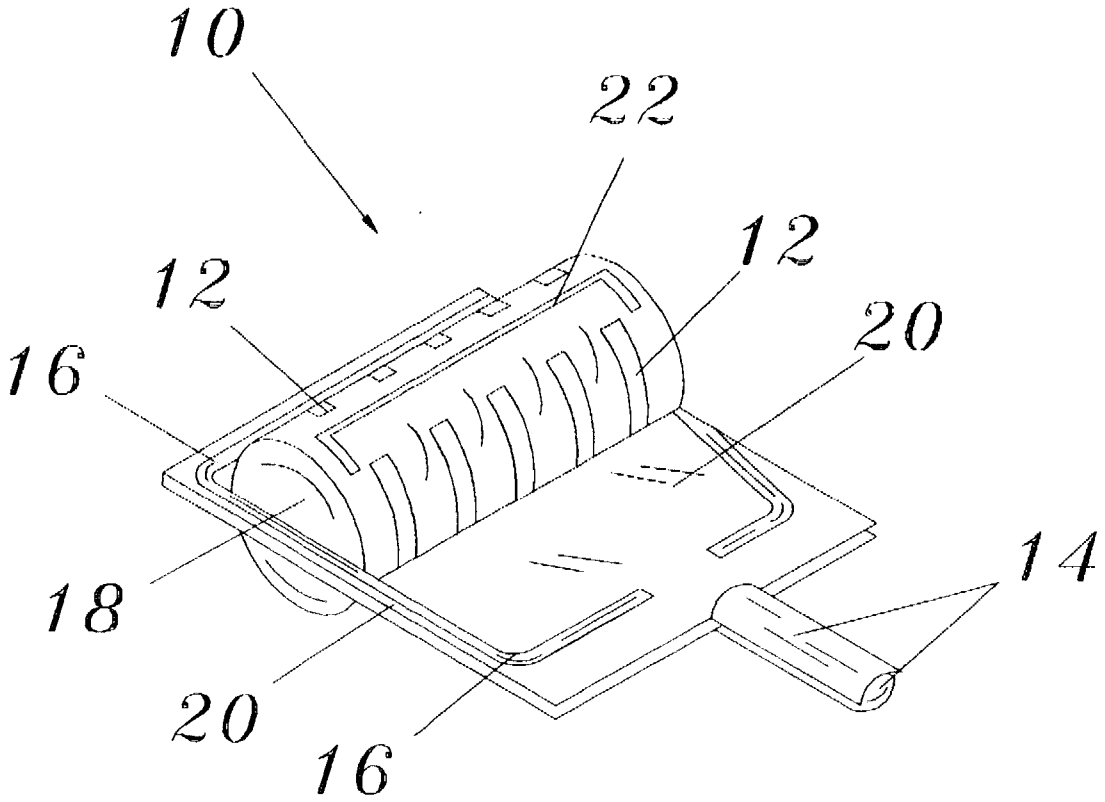
FIG. 1 is an elevated perspective view of the wash shield.
Figure 2:
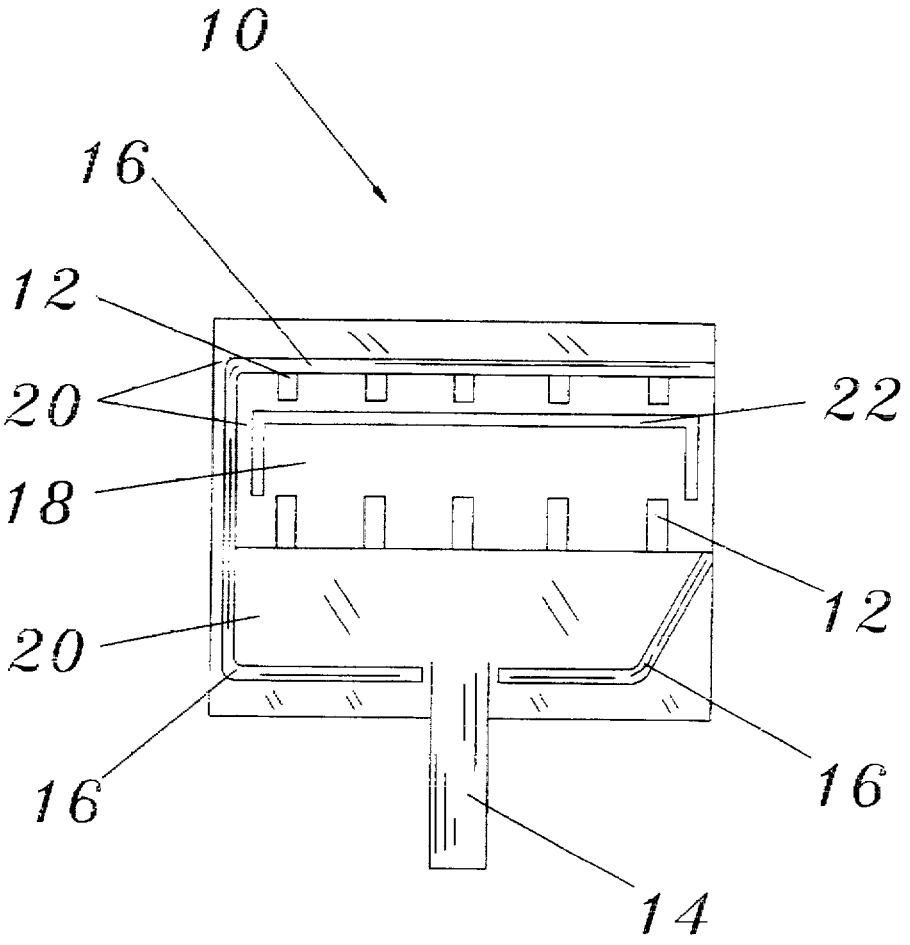
FIG. 2 is a top view of the wash shield.

With reference now to the drawings, and in particular to FIGS. 1 through 4 thereof, a new clear view wash shield 10 embodying the principles and concepts of the present invention will be described. As best illustrated in FIGS. 1 through 4, the clear view wash shield 10 comprises first/upper and second/lower shield halves, with each shield half including a flat portion 20 and a semi-cylindrical raised portion 18 within the flat portion. As shown, the shield halves are connected together such that the flat portions 20 face each other and the raised portions 18 form a cylindrical washing housing to enclose a conventional paint roller 24. The raised portions 18 include stiffening ribs 12 thereon which extend generally from the flat portions 20 toward the apex of the raised portions, leaving a smooth area located adjacent the apex of the raised portions. A flexible water inlet flap 22 is located in the smooth area of the raised portion 18 of the upper shield forming an inlet through which water can be introduced into the cylindrical washing housing from a conventional spray nozzle 26 or the like. Each of the shield halves is made from a transparent plastic material in order to permit a user to view the washing operation and determine when the roller is clean. Further, the raised portions 18 on both shield halves are preferably provided with outlet apertures to permit water and paint to drain from the cylindrical housing. Means could also be provided so as to selectively close the outlet apertures, thus permitting the roller to be soaked to loosen paint therefrom.

Figure 3:
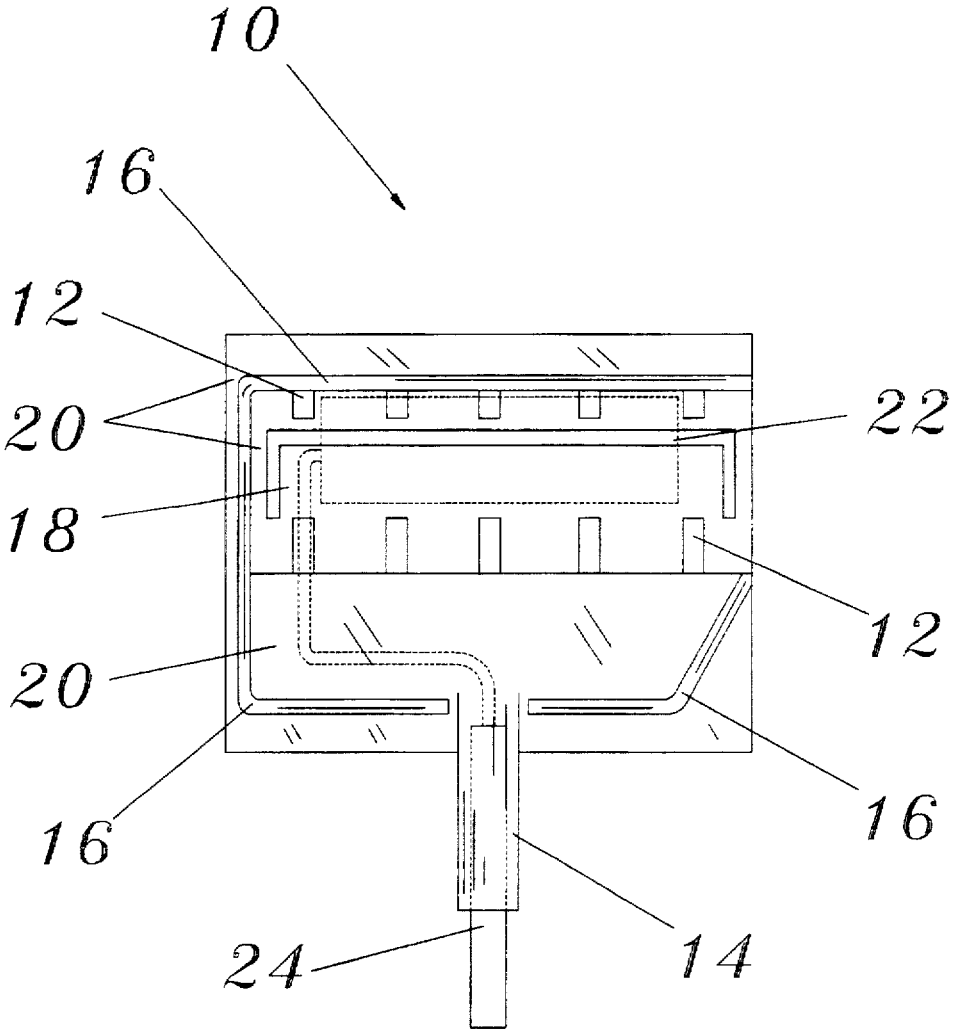
FIG. 3 is a top view similar to FIG. 2, but with a paint roller and handle within the wash shield.
Figure 4:
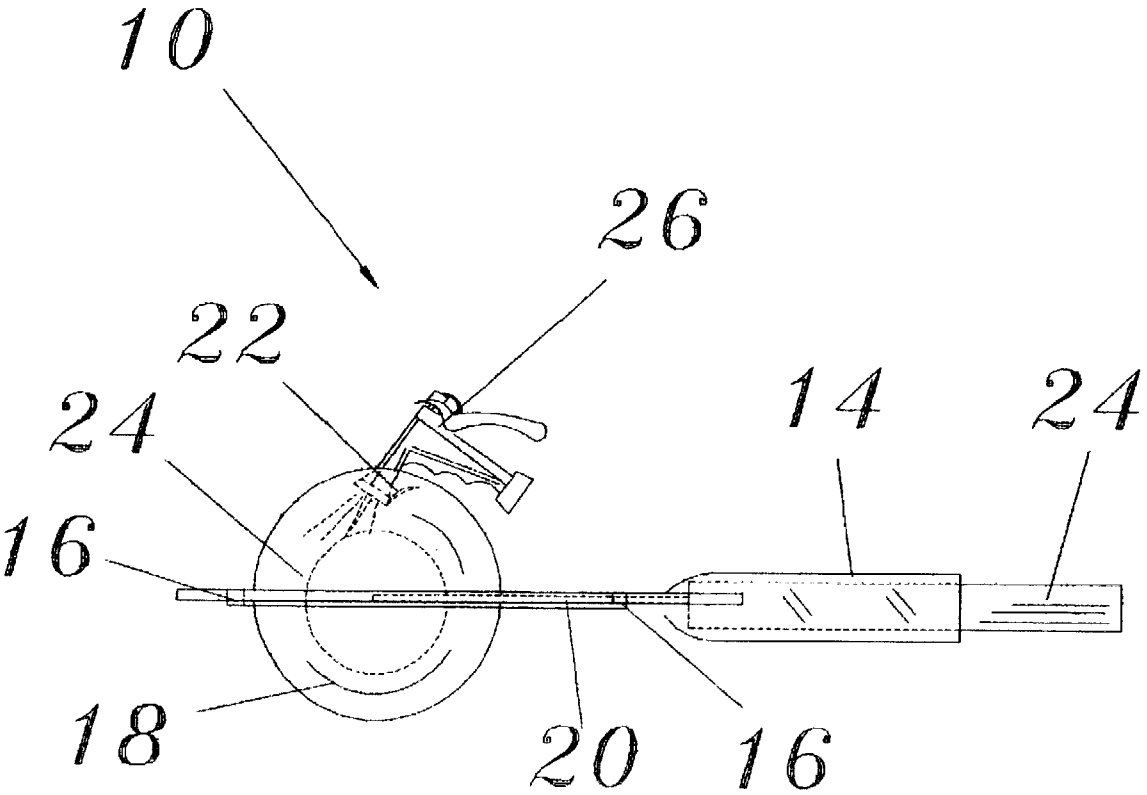
FIG. 4 is a side view of the wash shield with paint roller and handle therein.

Means are also provided so as to connect the shield halves together. The connection means preferably comprises a series of interfitting projections and grooves 16 located on the flat portions 20 of the shield halves. The projections could be located on the upper shield with the matching grooves located on the lower shield, or vice-versa, or a combination of both could be used. The shield halves further include semi-cylindrical handle portions 14 extending from the flat portions 20, which when the shield halves are connected together, form a handle housing to hold the handle of the paint roller 24, as shown in FIGS. 3 and 4.

To use the clear view wash shield, the roller of the paint roller is disposed within the lower raised portion 18 of the lower shield half with the handle of the paint roller disposed within the handle portion 14. The upper shield half is then connected to the lower shield half using the interfitting projections and grooves 16. Therefore the roller will be held for rotation within the cylindrical housing formed by the raised portions 18, with the handle securely held by the handle portions. The user can then firmly hold both the wash shield and the paint roller handle at the same time. The user then pushes the flexible inlet flap 22 inward into the housing using the spray nozzle, to allow water from the spray nozzle to be directed tangentially onto the roller, thus causing the roller to rotate. The action of the water on the roller and the centrifugal force from the rotation cause the roller to be cleaned. The inwardly directed flap retains the water and paint within the cylindrical housing so that the user is kept clean and dry. The slanted portion of the interconnecting grooves forces away water that escapes between the two halves back into the cylinder away from the user. The transparent material of the wash shield 10 allows the user to see when the roller is clean, and when clean, the spray nozzle is removed and the water inlet flap returns to its closed position.

To accommodate a left-handed person, the user could use clear box tape or other transparent tape material to tape off the inlet flap of the upper shield half and cut an inlet flap in the corresponding position on the lower shield half.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. A wash shield for washing a paint roller having a handle, comprising:

first and second shield halves, each shield half including a generally flat portion and a semi-cylindrical raised portion within the flat portion, said semi-cylindrical raised portions forming a cylindrical housing for the paint roller when the shield halves are connected together, one of said semi-cylindrical raised portions including a water inlet flap thereon through which water is introduced into the cylindrical housing.

2. The wash shield according to claim 1, wherein said water inlet flap is flexible.

3. The wash shield according to claim 1, wherein at least said semi-cylindrical raised portions are made from a transparent plastic material.

4. The wash shield according to claim 1, wherein said first and second shield halves are made from a transparent plastic material.

5. The wash shield according to claim 1, wherein said semi-cylindrical raised portions include stiffening ribs thereon.

6. The wash shield according to claim 1, wherein said first and second shield halves include means thereon for interlocking said shield halves.

7. The wash shield according to claim 6, wherein said means for interlocking comprises interfitting grooves and projections.

8. The wash shield according to claim 7, wherein said grooves and projections are located on the flat portions of said shield halves.

9. The wash shield according to claim 1, wherein each shield half includes a semicylindrical handle portion connected thereto, said handle portions forming a handle housing for the paint roller handle when the shield halves are connected together.

* * * * *